US005238371A

United States Patent [19]

Benckert

[11] Patent Number: 5,238,371

[45] Date of Patent: Aug. 24, 1993

[54] CONTROL ARRANGEMENT FOR A TWO-CYLINDER PUMP FOR THICK MATERIALS

[75] Inventor: Hartmut Benckert, Leinfelden-Echterdingen, Fed. Rep. of Germany

[73] Assignee: Putzmeister-Werk Maschinenfabrik GmbH, Aichtal, Fed. Rep. of Germany

[21] Appl. No.: 768,649

[22] PCT Filed: Jan. 18, 1990

[86] PCT No.: PCT/EP90/00099

§ 371 Date: Nov. 27, 1991

§ 102(e) Date: Nov. 27, 1991

[87] PCT Pub. No.: WO90/11449

PCT Pub. Date: Oct. 4, 1990

[30] Foreign Application Priority Data

Mar. 29, 1989 [DE] Fed. Rep. of Germany ..... 3910120

[51] Int. Cl.[5] ..... F04B 35/00

[52] U.S. Cl. ..... 417/345; 417/390; 417/900

[58] Field of Search ..... 417/344, 345, 339, 390, 417/900

[56] References Cited

U.S. PATENT DOCUMENTS 4,666,374 5/1987 Nelson ..... 417/345
4,790,728 12/1988 Dwyer ..... 417/900
5,066,203 11/1991 Coja et al. ..... 417/900

FOREIGN PATENT DOCUMENTS 3243738 5/1984 Fed. Rep. of Germany .
89/11037 11/1989 World Int. Prop. O. .

*Primary Examiner*—Richard A. Bertsch
*Assistant Examiner*—Charles G. Freay
*Attorney, Agent, or Firm*—Kenyon & Kenyon

[57] ABSTRACT

A control system for a pump for thick materials in which the pump has a hydropump with a delivery-volume regulator for adjusting the delivery volume of the hydropump in response to a setpoint signal. A baffle member is coupled between the delivery cylinders of the pump and a delivery line, and a reversing member is coupled to the baffle member for reversing the baffle member to alternately couple the delivery cylinders to the delivery line and to a material dispenser container. A sampling device responsive to the end of the pressure stroke of the delivery cylinders transmits an end-position signal for initiating the reversal of the baffle member by the reversing member. A switching member is coupled by an output to the delivery-volume regulator of the hydropump and coupled by an input to the sampling device for receiving the end-position signals and for transmitting setpoint signals to the delivery-volume regulator. During the stroke phase of the drive cylinders of the pump and during the reversal process of the reversing member, the delivery-volume regulator receives setpoint signals which are independent of one another for initiating the reversing strokes of the drive cylinders at the end of each reversal of the baffle member.

20 Claims, 6 Drawing Sheets

CONTROL ARRANGEMENT FOR A TWO-CYLINDER PUMP FOR THICK MATERIALS

Figure 1A:
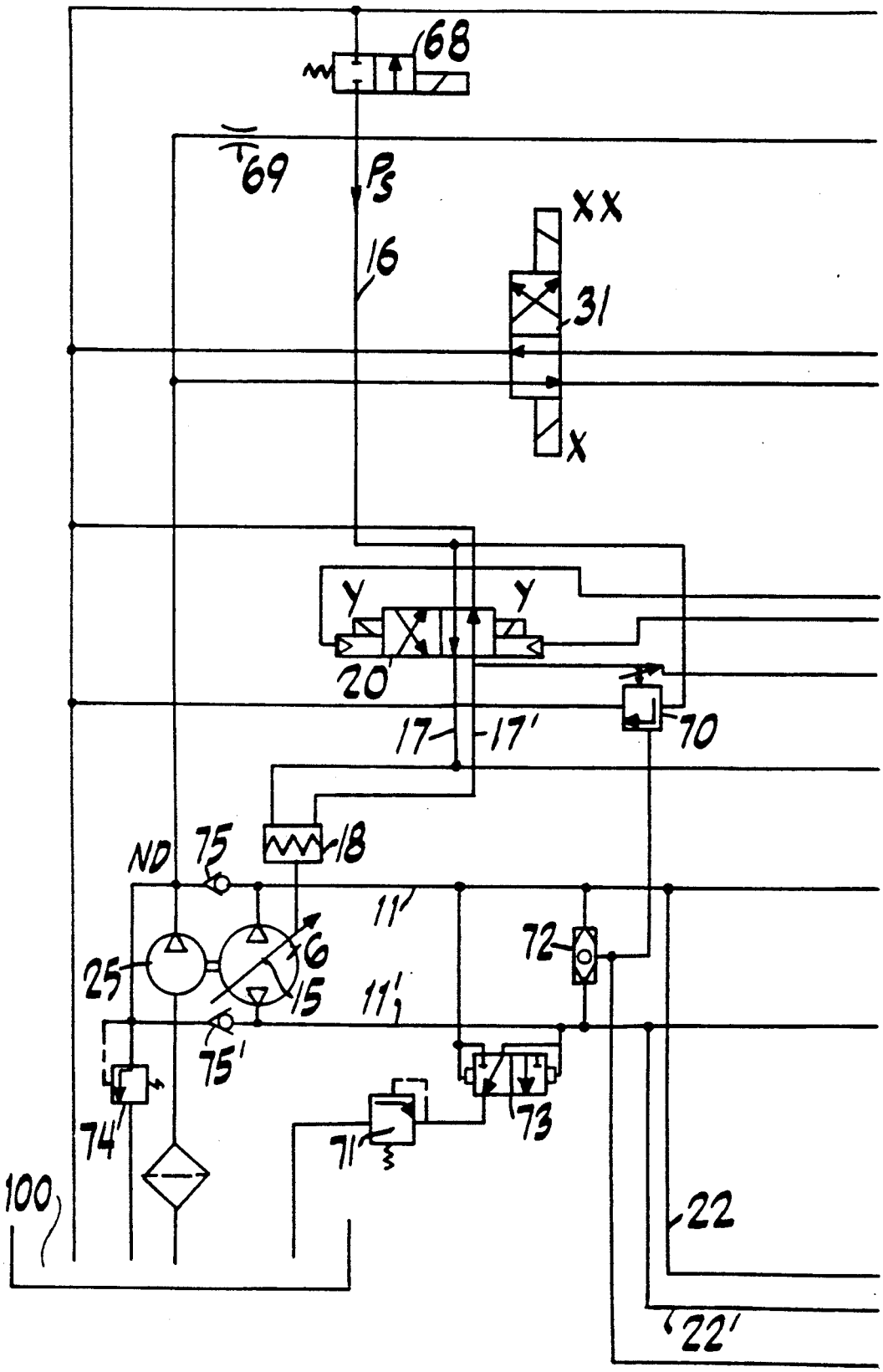

The invention relates to a control arrangement for a two-cylinder pump for thick materials with at least one hydropump whose delivery volume is adjustable by means of a setpoint signal, with two delivery cylinders which communicate with a material dispenser container and which can be actuated in push-pull operation by means of drive cylinders that are controlled by the hydropump, with a baffle arrangement for the material flow, which alternately connects the delivery cylinders to the material dispenser container and to a delivery line, and which is preferably designed as a shunt pipe and can be actuated by means of a reversing mechanism, and with one sampling device which responds to the end of each pressure stroke of the drive cylinder, and/or delivery cylinder and at whose output an end-position signal which initiates a reversal process for the baffle arrangement is adapted to be tapped off, and with a switching element, which is connected on the output side to a delivery-volume regulator of the hydropump and which features a control input that receives the end-position signals or the control signals derived from the end-position signals by means of signal conversion, as well as at least two switch positions which are adjustable by means of the signal level at the control input for the forced tripping of various setpoint signals to the delivery-volume regulator.

A known control arrangement of this type (DE-A-3 243 738) provides for a switching element that is connected on the output side to the delivery-volume regulator of the hydropump. After the stroke direction is reversed in the drive and delivery cylinders, this switching element trips the hydropump by force to the maximum delivery quantity. In this manner, the delivery gap that develops when the shunt pipe is reversed is supposedly filled in, and one supposedly attains a substantially uniform flow of delivered material at the end of the delivery line. In the case of the known arrangement, it is considered disadvantageous that the reversal of the tube switch is initiated simultaneously with the stroke reversal in the delivery cylinders by means of a reversing mechanism which is capable of being actuated independently by the hydropump. For this, an additional hydraulic pump is required. A similar arrangement had also already been proposed by the unpublished, older priority document WO 89/11037.

Starting from here, the object of the invention is to create a control arrangement for two-cylinder pumps for thick materials, with which the delivery volume of the hydropump can be optimally adapted in a one-way flow configuration to the prevailing requirements in the course of a delivery and reversal cycle.

The inventive solution begins with the realization that during the time the baffle arrangement is reversed, a quantity of oil is required that is dependent upon the quantity of oil for the delivery stroke. For one-way flow configurations, there is therefore a need to adjust the delivery volume of the hydropump to the specific operating condition. To achieve this, the invention proposes that the drive cylinders and the hydraulic reversing mechanism of the baffle arrangement be able to be actuated alternately by means of a servo control with pressure oil from the same hydropump, and that during the stroke phase of the drive cylinders and during the reversal process of the reversing mechanism, the delivery-volume regulator of the hydropump be able to receive setpoint signals, which are independent of one another. The stroke reversal in the drive cylinders is thereby advantageously initiated by means of a primary detector which can be actuated at the end of each reversal process of the baffle arrangement. A preferred refinement of the invention provides that in accordance with the switch position of the switching element, the setpoint values can show a selectable, functional dependence on the operating parameters of the two-cylinder pump for thick materials, in particular, of the hydropump. For example, the setpoint signals can be varied in dependence upon a specified maximum delivery pressure or in dependence upon a specified maximum value of the product of the delivery volume and the delivery pressure of the hydropump.

According to a preferred refinement of the invention, a signal converter, which can receive the end-position signal that essentially forms a square-wave signal, is arranged in front of the control input of the switching element on the input side. The output signal of this signal converter exhibits an adjustable trailing edge that lags in comparison with the input signal. The purpose of this is to achieve that after the shunt pipe is reversed and the direction of delivery in the delivery cylinders is subsequently reversed, the hydropump acts at first with a specified delivery volume on the thick-material column to be pushed along, which leads to a defined acceleration of the column and to a pre-compression of the material found inside. On the other hand, the leading edges of the input and output signals of the signal converter coincide temporally for the most part, so that immediately after completion of each pressure, stroke the shunt pipe is reversed substantially without delay.

The signal converter advantageously features a time-delay element which responds to the trailing edge of the end-position signal and preferably has adjustable delay time. The signal converter, which, for example, has a hydraulic design, can thereby feature an adjustable choke and a non-return valve which is connected in parallel to the choke and open from the sampling device toward the control input. In the case of an electrical signal converter, a time-delay circuit, which responds to the trailing edge of the electric end-position signal, can be provided. As a time-delay element, it has an adjustable digital counter or an adjustable RC element, for example.

According to another preferred embodiment of the invention, the switching element is designed as a directional control valve, which has an electrically, hydraulically, or pneumatically operable pilot valve as a control input, at least two selection connections, which can be adjusted to different pressures, and one working connection, which is connected to the regulator for the hydropump and can be selectively connected to one of the selection connections. It is expedient, thereby, that at least one of the selection connections is capable of receiving a variably adjustable setpoint signal.

According to another preferred refinement of the invention, the directional control valve can be reversed between at least two control strands arranged on the side of the selection connections and equipped with chokes, pressure-keeping valves and/or relief valves. In particular, the directional control valve can be reversed between at least two parallel strands of a low-pass filter configured on the side of the selection connections, whereby an adjusting choke is arranged in at least one of the parallel strands. The control strands or low-pass filters can preferably be charged by way of an auxiliary pump with a preselected control pressure. In addition, other switching functions can be activated by means of the switching element in the course of the reversal process initiated by the end-position signals. Thus, for example, according to the switch position of the switching element, high-pressure restrictions or torque restrictions, which are adapted to the specific needs, can be made by influencing the setpoint signals accordingly.

Figure 1B:
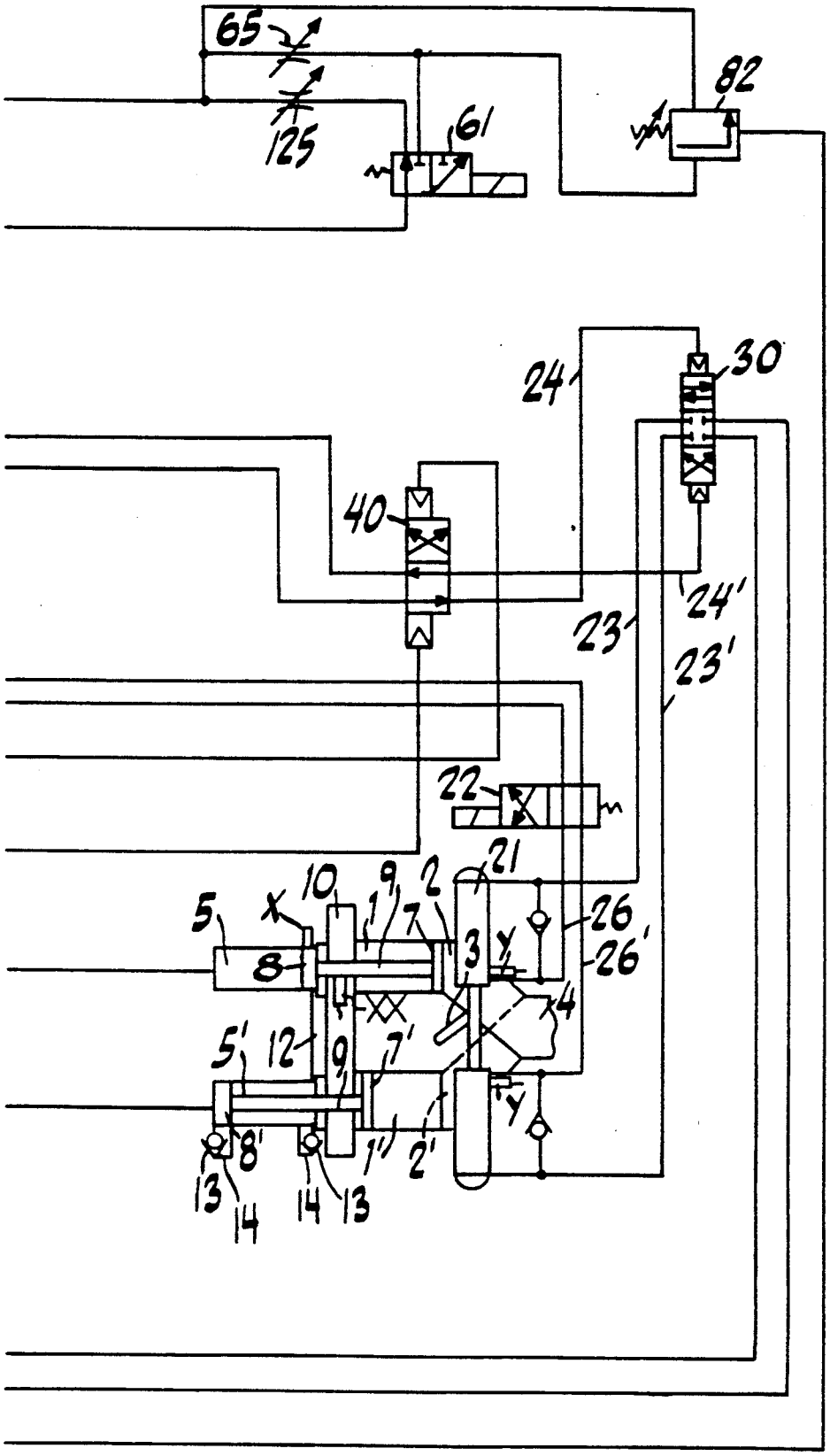
Figure 2:
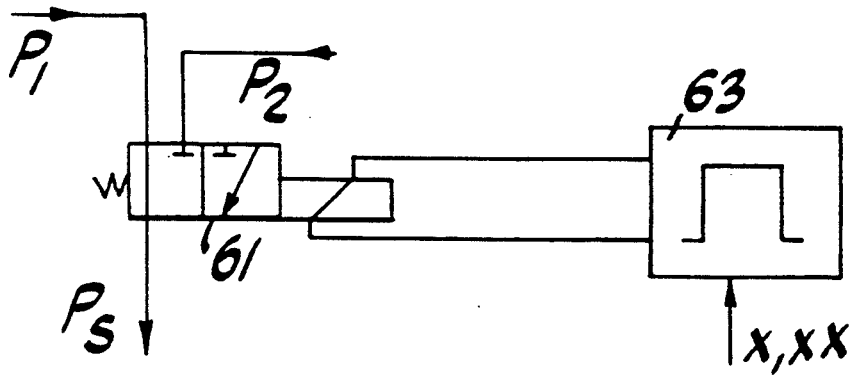
Figure 3:
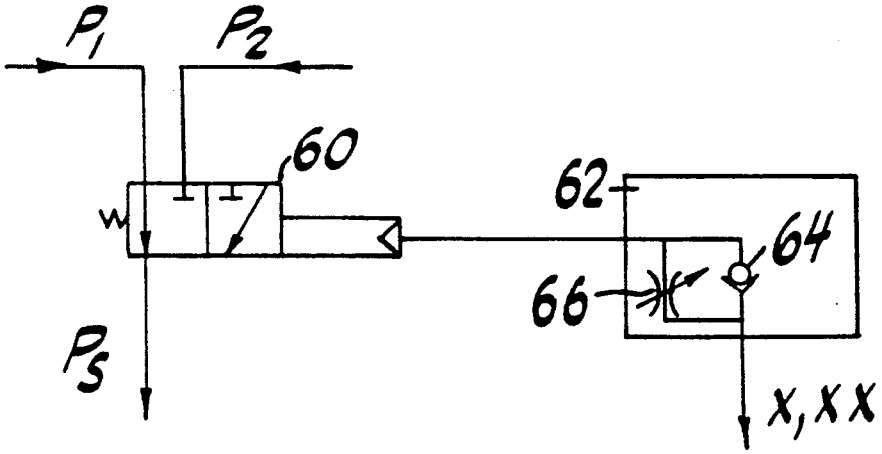
Figure 4A:
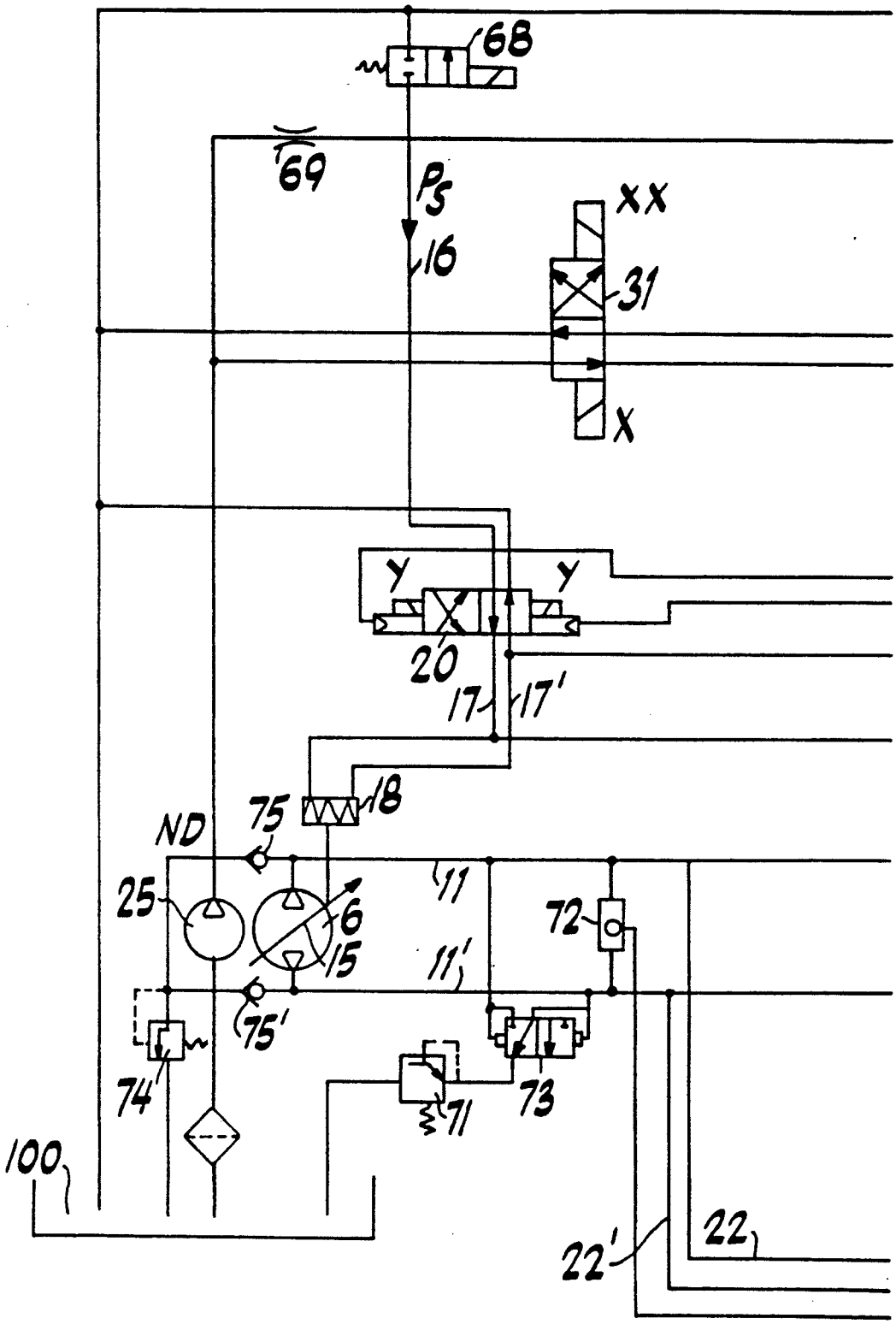
Figure 4B:
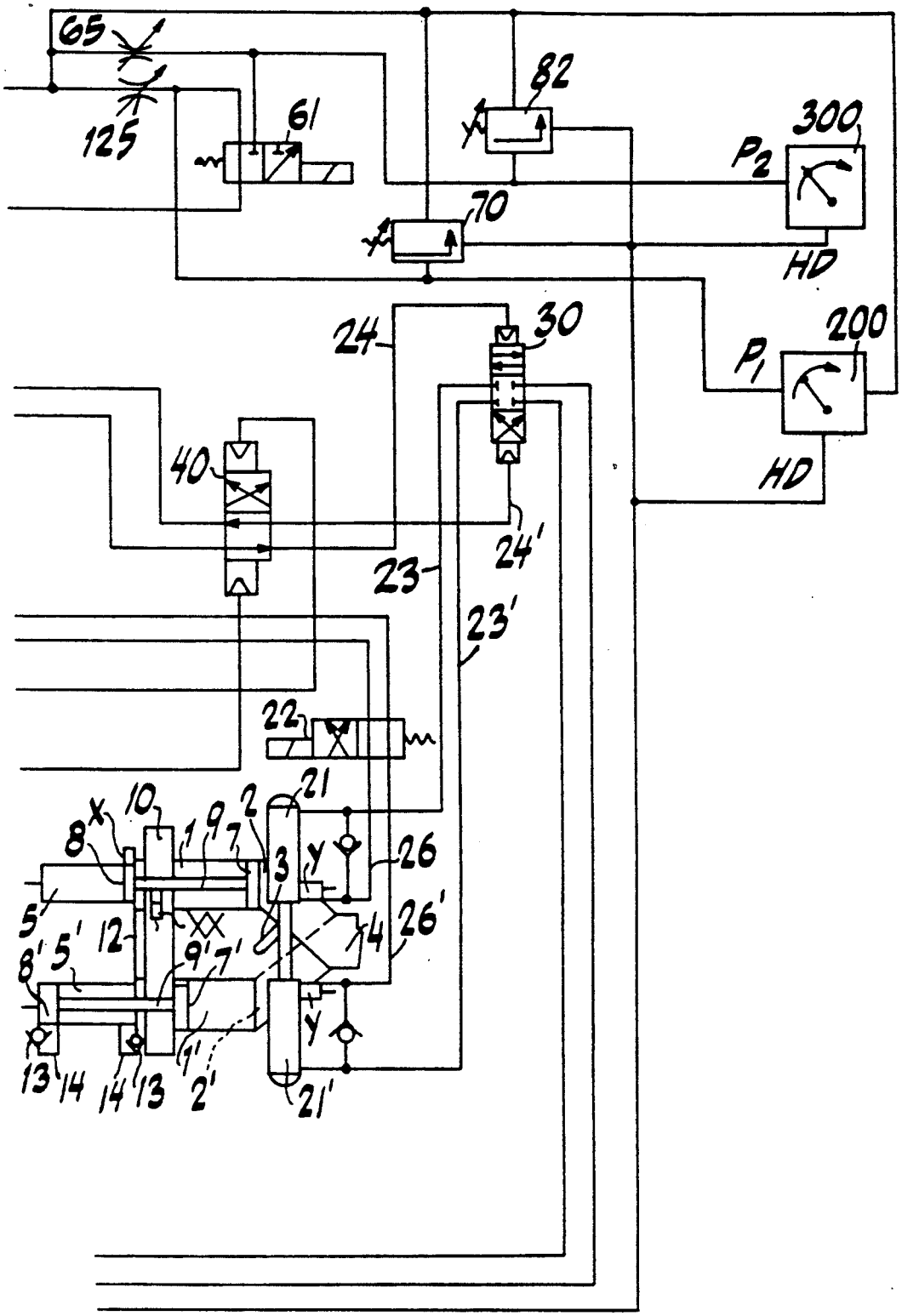

The invention shall be clarified in greater detail in the following based on a few exemplified embodiments which are depicted schematically in the drawings. The Figures illustrate as follows:

FIG. 1(a) and 1(b) a circuit diagram of a control arrangement for a two-cylinder pump for thick materials with a free-flow servo control of drive cylinders and shunt-pipe cylinders in a one-way flow configuration;

FIG. 2 a switching element for controlling delivery volume with an electrical time-delay element;

FIG. 3 a switching element for controlling delivery volume with a hydraulic time-delay element;

FIG. 4(a) and 4(b) a circuit diagram of a control arrangement corresponding to FIG. 1(a) and 1(b) with additional switching functions.

Figure 5:
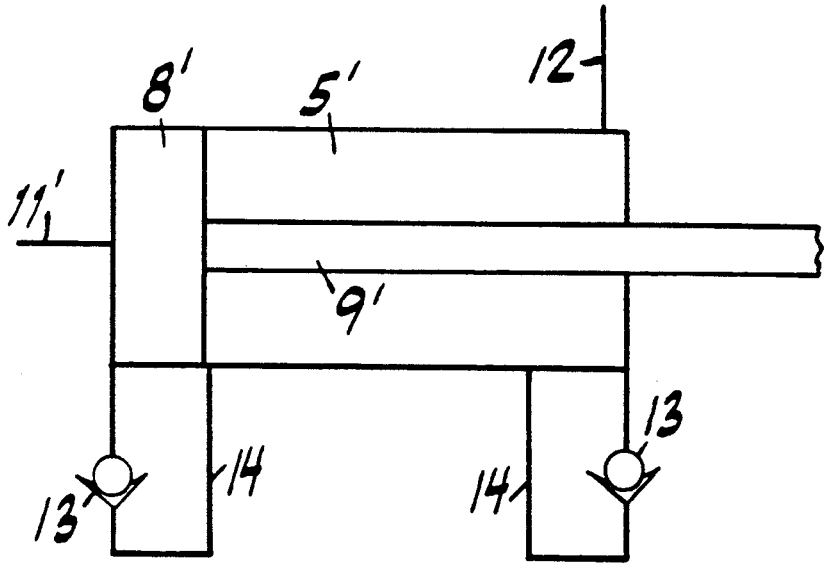

FIG. 5 an enlarged view of the pressure equalizing line shown in FIG. 1(b).

The pump for thick materials essentially comprises two delivery cylinders 1,1', whose front-face openings 2,2' open into a material dispenser container (not shown) and can be connected alternately during the pressure stroke via a shunt pipe to a delivery line 4. The delivery cylinders 1,1' are actuated in push-pull operation by means of hydraulic drive cylinders 5,5' and by means of the reversing hydropump 6 conceived in the depicted exemplified embodiment as a swash-plate axial piston pump. For this purpose, the delivery pistons 7,7' are each connected by way of a common piston rod 9,9' to the pistons 8,8' of the drive cylinders 5,5'. Situated between the delivery cylinders 1,1' and the drive cylinders 5,5' is a water tank 10, through which the piston rods 9,9' penetrate.

In the depicted exemplified embodiment, the drive cylinders 5,5' are charged with pressure oil at the head end via the pressure lines 11,11' of the main circuit with the help of the reversing pump 6, and are hydraulically interconnected at their rod ends via a shunt line 12. As also shown in FIG. 5, for purposes of stroke correction, a pressure-equalizing line 14, which contains a non-return valve 13 and which bridges over the concerned driving piston 8' in its end positions, is arranged at both ends of the drive cylinder 5'.

The moving direction of the driving pistons 8,8', and thus of the delivery pistons 7,7', is reversed in that the swash plate 15 of the reversing pump 6, released by a reversing element, swings through the neutral position, and consequently changes the delivery direction of the pressure oil in the lines 11,11' of the main circuit in free flow. At a specified driving speed, the delivery volume of the reversing pump 6 is determined by the tilt angle of the swash plate 15. The swashplate angle and thus the delivery volume can be adjusted proportionally to a control pressure $p_s$, which actuates the slave cylinder 18 by way of the lines 16, 17 and 17' and the reversing valve 20 situated in the path of the concerned line. In accordance with the switching states of the pump for thick materials, the control pressure $p_s$ is varied by the means clarified further in the following. To adjust the high-pressure and low-pressure level in the main circuit, pressure regulators 70 and 71 are provided whose control inputs are able to be connected via a selector valve 72 or a directional control valve 73 to the line 11,11' of the main circuit which conducts at any one time the high pressure or low pressure.

The shunt pipe 3 is reversed by means of the hydrocylinders 21,21'. They are preferably conceived as plunger cylinders and are directly charged by way of the lines 22,22' which branch off from the main circuit, through the reversing valve 30 and the pressure lines 23,23', with pressure oil delivered by the reversing pump 6. The pilot control of the reversing valve 30 takes place in the case of the depicted exemplified embodiment hydraulically via the lines 24,24', which can be pressurized by way of the directional control valves 31 and 40 with the control pressure of an auxiliary pump 25 which is driven jointly with the reversing pump 6. The auxiliary pump 25 also charges the closed main circuit via the non-return valves 75,75' and is safeguarded by the relief valve 74. The directional control valve 31 can be actuated by means of the electrically, or possibly also hydraulically tapped-off end-position signals x or xx of the drive cylinder 5, while the directional control valve 40 is able to be reversed in accordance with the pressure prevailing in the control lines 17,17' which lead to the slave cylinder 18. The main valve 20, which determines the delivery direction of the reversing pump 6, is actuated by means of end-position signals from the shunt-pipe cylinders 21,21', which are adapted to be tapped off via the hydraulic lines 26,26' and/or via electrical primary detectors y.

The control pressure $p_s$, which controls the delivery-volume regulator 18 of the hydropump 6, is automatically adjusted according to the switching states of the pump for thick materials by means of a circuit arrangement conceived in the depicted exemplified embodiment as a low-pass filter, by way of a directional control valve 61 (FIG. 1(a) and 1(b) and 2) or 60 (FIG. 3). On the side of the upstream choke 69, the low-pass filter is charged with low pressure ND by way of the auxiliary pump 25 and is connected to the tank 100 on the side of the variable orifices 65 and 125 arranged in parallel strands. If the flow of pressure oil across the choke 125 is interrupted, then the entire low pressure ND is tapped off as a control pressure $p_s$ due to the lack of a pressure drop across the choke 69, so that the regulator 18 trips the main pump 6 by force into the full swashplate angle. During the delivery stroke, the directional control valve 61 (or 60) is situated in its spring-centered position, in which the passage to the variable orifice 125 is open and the pressure oil flows off from the fixed orifice 69 through the variable orifice 125 in the direction of the tank. The result is a pressure drop, on the basis of which the control pressure $p_s$ is adapted to a value (control setpoint selection $p_1$) which is smaller than the low pressure ND. Accordingly, the main pump 6 is regulated by means of the regulator 18 to a new swashplate angle which is proportional to the control pressure $p_s$ and which corresponds to the desired delivery volume in the stroke phase. At the end of each delivery stroke, one end-position signal x or xx at a time is tapped off by an electrical or hydraulic sampling device in the vicinity of the drive cylinder 5 and applied by means of an electrical or hydraulic signal converter including a time delay element 63 or 62 to the electromagnetic or hydraulic piloting input of the directional control valve 61 or 60. In this manner, the control pressure $p_s = p_2$ is then adjusted by means of the low-pass filter between the upstream choke 69 and the variable orifice 65 (control setpoint selection $p_2$). During the reversal phase of the shunt pipe, therefore, a new higher or lower control pressure $p_S$ is adjusted, depending on the requirements, to control the delivery-volume regulator 18. While the leading edge of the end-position signal x or xx tapped off at the drive cylinder 5 leads nearly without time delay to a reversal of the directional control valve 61 or 60 (in the hydraulic case according to FIG. 3, this is guaranteed by the non-return valve 64), the reversal of the directional control valve 61 or 60 is delayed by the time-delay element 63 or 62 at the end of the reversal phase and thus at the beginning of the new delivery stroke (in the case of FIG. 3, this is caused by the variable orifice 66). Thus, after the shunt pipe 3 is reversed and the delivery direction in the delivery cylinders 5,5' is subsequently reversed, the reversing pump 6 in the main circuit acts first with the previously adjusted delivery volume on the thick-material column to be pushed along. Given a higher, previously adjusted delivery volume, this leads, for example, to a short-term acceleration of the thick-material column and to a precompression of the material found inside. Furthermore, a high-pressure relief valve 82 is arranged on the side of the adjusting choke 65 of the low-pass filter. It makes it possible to adjust the maximum high pressure during the reversal phase with time delay. In case of high pressure, the relief valve 82 lowers the control pressure between the choke 69 and the variable orifice 65, so that the main pump 6 can be tilted back to a correspondingly lower delivery volume, in particular to the delivery volume 0. An externally controllable reversing valve 68 is situated in another strand of the low-pass filter. It is blocked in the spring-centered position and, in the connected-through position behind the choke 69, it constitutes a direct outlet to the tank, so that above the control pressure $p_S=0$, the hydropump 6 can be switched to the delivery volume 0. The depicted circuit arrangement leads to a servo control of the drive cylinders 5,5' and of the shunt-pipe cylinders 21,21'. It functions as follows:

When in the course of a delivery process, for example, when the rod-side end position of the driving piston 8 in the drive cylinder 5 is reached, a reversal of the directional control valve 31 and of the directional control valve 61 (or 60) is initiated by means of the end-position signal x that is tapped off electrically. As a result, the reversing valve 30 is reversed while initiating a reversal process at the shunt-pipe cylinders 21,21', whereby the delivery direction of the reversing pump 6 is initially retained, and the driving pistons 8,8' are kept in their respective end position by means of the pressure oil in line 11. When the shunt pipe 3 reaches its end position, the valve 20 is reversed by means of the corresponding end-position signal. As a result, the pilot control on the slave cylinder 18 changes, so that the swash plate 15 of the reversing pump 6 swings through while the delivery direction is reversed. Since the directional control valve 61 (or 60) is reversed with time delay by means of the time-delay element 63 (or 62), the delivery volume of the hydropump 6 is initially determined by the low-pass filter 69,65 (control setpoint selection $p_2$) and changed over to the value (control setpoint selection $p_1$) defined by the low-pass filter 69, 125. Parallel to this, the reversal signal is tapped off between the valve 20 and the slave cylinder 18 and fed to the pilot control of the valve 40. The valve 40 consequently changes its position and thus assures that the shunt-pipe cylinders 21,21' retain the previously assumed end position in spite of the reversal of the delivery direction of the reversing pump 6. By means of the return-delivery valve 22 connected upstream from the reversing valve 20 in the control lines 26,26', the drive cylinders 5,5' can be charged, as needed, in the opposite way, so that material is delivered out of the delivery line back into the material dispenser container.

In the exemplified embodiment according to FIG. 1(a) and 1(b), in the spring-centered position of the directional control valve 61, only the high-pressure relief valve 70 is effective, while in the connected-through position of the valve 61, the high-pressure restricting valve 82 is connected in parallel to this. Therefore, only a pressure limiting value that is lower than on the valve 70 can be usefully adjusted on the relief valve 82. This is synonymous with the fact that in the position of the valve 61 that is tripped by force, only a limiting pressure can be adjusted that is lower than in the spring-centered position of this valve.

This disadvantage is avoided in the case of the exemplified embodiment depicted in FIG. 4(a) and 4(b), in that the valve 70 is placed in one of the selection-side control strands of the selector valve 61, so that the limiting pressure can be adjusted in both switch positions independently of one another. Furthermore, regulating valves 200 and 300 are arranged in both control strands. Their control inputs are connected via the selector valve 72 to the high-pressure side of the hydropump 6. They regulate the setpoint pressure $p_1$ or $p_2$ which is applied to the input according to a hyperbolic dependency of high pressure and delivery volume (setpoint value $p_1$, $p_2$). Consequently, a torque limitation for the driving motor of pump 6 can be adapted to the requirements during the delivery process and during the reversal process.

The described one-way flow configuration is suited above all for smaller or slow-running systems, where it is crucial to have the least possible amount of hydraulic units. For large, fast-running machines, a two-way sequential circuit presents itself, in which the shuntpipe reversing valve 30 is not connected via lines 22,22 to the main circuit, but rather to a separate hydraulic circuit. In the latter case, the directional control valve 40 can be dropped. The interface circuit which is capable of being reversed through the directional control valve 60 or 61 by means of the end-position signals x and xx can moreover also be advantageously employed in hydraulic servo controls with hydropumps having only one flow direction and one reversing slide valve in the main delivery line.

I claim:

1. A control system for a pump for thick materials, wherein the pump includes at least one hydropump including a delivery-volume regulator for adjusting the delivery volume of the hydropump in response to at least one setpoint signal; two delivery cylinders coupled to a material dispenser container for pumping material into the material dispenser container; two drive cylinders coupled between the hydropump and the delivery cylinders, and controlled by the hydropump to actuate the delivery cylinders in a push-pull manner; a baffle member coupled between the delivery cylinders and a delivery line for alternately coupling the delivery cylinders to the delivery line and the material dispenser container upon reversal of the baffle member; comprising:

a reversing member coupled to the baffle member for reversing the baffle member to alternately couple the delivery cylinders to the delivery line and to the material dispenser container, wherein the reversing member is actuated alternately with the drive cylinders by pressure oil from the hydropump;

a sampling device responsive to the end of the pressure stroke of at least one drive cylinder and/or at least one delivery cylinder for transmitting an end-position signal for initiating the reversal of the baffle member by the reversing member; and a switching member coupled by an output to the delivery-volume regulator of the hydropump and coupled by an input to the sampling device for receiving the end-position signals and for transmitting setpoint signals to the delivery-volume regulator, whereupon during the stroke phase of the drive cylinders and during the reversal process of the reversing member, the delivery-volume regulator receives setpoint signals which are independent of one another for initiating the reversing strokes of the drive cylinders at the end of each reversal of the baffle member, wherein the setpoint signals are dependent upon operating parameters of the hydropump based on the position of the switching member.

2. A control system as defined in claim 1, wherein the setpoint signals are adjusted based upon a maximum delivery pressure of the hydropump selected in accordance with the switch position of the switching member.

3. A control system as defined in claim 1, wherein the setpoint signals are changed based upon the maximum value of the product of the delivery volume and the delivery pressure of the hydropump selected in accordance with the switch position of the switching member.

4. A control system for a pump for thick materials, wherein the pump includes at least one hydropump including a delivery-volume regulator for adjusting the delivery volume of the hydropump in response to at least one setpoint signal; two delivery cylinders coupled to a material dispenser container for pumping material into the material dispenser container; two drive cylinders coupled between the hydropump and the delivery cylinders, and controlled by the hydropump to actuate the delivery cylinders in a push-pull manner; a baffle member coupled between the delivery cylinders and a delivery line for alternately coupling the delivery cylinders to the delivery line and the material dispenser container upon reversal of the baffle member; comprising:

a reversing member coupled to the baffle member for reversing the baffle member to alternately couple the delivery cylinders to the delivery line and to the material dispenser container, wherein the reversing member is actuated alternately with the drive cylinders by pressure oil from the hydropump;

a sampling device response to the end of the pressure stroke of at least one drive cylinder and/or at least one delivery cylinder for transmitting an end-position signal for initiating the reversal of the baffle member by the reversing member;

a switching member coupled by an output to the delivery-volume regulator of the hydropump and coupled by an input to the sampling device for receiving the end-position signals and for transmitting setpoint signals to the delivery-volume regulator, whereupon during the stroke phase of the drive cylinders and during the reversal process of the reversing member, the delivery-volume regulator receives setpoint signals which are independent of one another for initiating the reversing strokes of the drive cylinders at the end of each reversal of the baffle member; and a signal converter coupled between an input of the switching member and the sampling device for transmitting an output signal to the switching member responsive to an end-position signal which exhibits an adjustable trailing edge that lags relative to the end-position signal.

5. A control system as defined in claim 4, wherein the leading edge of the output signal of the signal converter substantially coincides with the end-position signal.

6. A control system as defined in claim 4, wherein the signal converter is hydraulic and includes an adjustable choke and a non-return valve coupled in parallel relative to the adjustable choke and open in the direction from the sampling device toward the input of the switching member.

7. A control system as defined in claim 4, wherein the signal converter includes a time-delay element responsive to the trailing edge of the end-position signal.

8. A control system as defined in claim 7, wherein the time delay is an adjustable time delay.

9. A control system as defined in claim 7, wherein the time-delay element includes an electronic circuit including a digital counter and an RC element.

10. A control system for a pump for thick materials, wherein the pump includes at least one hydropump including a delivery-volume regulator for adjusting the delivery volume of the hydropump in response to at least one setpoint signal; two delivery cylinders coupled to a material dispenser container for pumping material into the material dispenser container; two drive cylinders coupled between the hydropump and the delivery cylinders, and controlled by the hydropump to actuate the delivery cylinders in a push-pull manner; a baffle member coupled between the delivery cylinders and a delivery line for alternately coupling the delivery cylinders to the delivery line and the material dispenser container upon reversal of the baffle member; comprising:

a reversing member coupled to the baffle member for reversing the baffle member to alternately couple the delivery cylinders to the delivery line and to the member is actuated alternately with the drive cylinders by pressure oil from the hydropump;

a sampling device responsive to the end of the pressure stroke of at least one drive cylinder and/or at least one delivery cylinder for transmitting an end-position signal for initiating the reversal of the baffle member by the reversing member; and a switching member coupled by an output to the delivery-volume regulator of the hydropump and coupled by an input to the sampling device for receiving the end-position signals and for transmitting setpoint signals to the delivery-volume regulator, whereupon during the stroke phase of the drive cylinders and during the reversal process of the reversing member, the delivery-volume regulator receives setpoint signals which are independent of one another for initiating the reversing strokes of the drive cylinders at the end of each reversal of the baffle member, wherein the switching member is comprised of a directional control valve including a pilot valve as a control input, at least two selection connections adjustable to different setpoint signals, and one working connection which is coupled to the delivery-volume regulator of the hydropump and can be selectively coupled to one of the selection connections.

11. A control system as defined in claim 10, wherein the pilot valve is selected from the group including electrically, hydraulically, and pneumatically operable pilot valves.

12. A control system as defined in claim 10, wherein at least one of the selection connections receives a variably adjustable setpoint value.

13. A control system as defined in claim 10, wherein the directional control valve can be reversed between at least two parallel lines of a low-pass filter coupled to at least one selection connection.

14. A control system as defined in claim 13, wherein an adjusting choke is located in at least one of the parallel lines of the low-pass filter.

15. A control system as defined in claim 13, wherein the at least two parallel lines of the low-pass filter are charged by means of an auxiliary pump having a predetermined control pressure.

16. A control system as defined in claim 10, wherein the directional control valve can be reversed between at least two control lines, each being coupled to a respective selection connection.

17. A control system as defined in claim 16, wherein each control line includes an element selected from the group including a choke, a pressure-keeping valve, and a relief valve.

18. A control system as defined in claim 16, wherein the control lines are charged by means of an auxiliary pump having a predetermined control pressure.

19. A control system as defined i claim 16, wherein an adjustable relief valve is coupled to at least one of the control lines and is coupled by a pilot input to the high-pressure side of the hydropump and controls the setpoint signal applied as hydraulic pressure.

20. A control system as defined in claim 16, wherein at least one of the control lines is coupled to a respective regulating valve, which is in turn coupled to the high-pressure side of the hydropump for adjusting the setpoint signal based 7 upon the product of the high pressure and the setpoint value.

* * * * *

UNITED STATES PATENT AND TRADEMARK OFFICE

CERTIFICATE OF CORRECTION

PATENT NO. : 5,238,371

DATED : August 24, 1993

INVENTOR(S) : BENCKERT, Hartmut

It is certified that error appears in the above-indentified patent and that said Letters Patent is hereby corrected as shown below:

In Column 8, line 45, change "the member" to

-- ... the material dispenser container, wherein the reversing member ... --

In Column 10, line 10, change "i" to

-- in --.

Signed and Sealed this

Eighth Day of November, 1994

Bruce Lehman

*Attest:*

BRUCE LEHMAN

*Attesting Officer*

*Commissioner of Patents and Trademarks*